US007373706B2

(12) United States Patent
Savoie

(10) Patent No.: US 7,373,706 B2
(45) Date of Patent: May 20, 2008

(54) APPARATUS AND METHOD FOR GENERATING AN OPTICAL SURFACE ON A WORKPIECE

(75) Inventor: Marc Savoie, Wetzlar (DE)

(73) Assignee: Satisloh GmbH, Wetzlar (DE)

( * ) Notice: Subject to any disclaimer, the term of this patent is extended or adjusted under 35 U.S.C. 154(b) by 0 days.

(21) Appl. No.: 11/787,829

(22) Filed: Apr. 18, 2007

(65) Prior Publication Data

US 2007/0264096 A1 Nov. 15, 2007

(30) Foreign Application Priority Data

May 12, 2006 (EP) ..... 06009895

(51) Int. Cl.
*B23B 27/00* (2006.01)

(52) U.S. Cl. ..... 29/27 C; 29/28; 409/132; 409/165

(58) Field of Classification Search ..... 29/27 C, 29/28, 557, 558, 559; 409/132, 80, 84, 141, 409/145, 163, 164, 165, 199, 204, 205, 206, 409/207, 208; 82/1.11, 118, 132, 133, 124; 451/42, 43, 44, 5, 11; 408/26, 130; 407/33, 407/34, 40, 42, 53

See application file for complete search history.

(56) References Cited

U.S. PATENT DOCUMENTS 4,369,007 A * 1/1983 Canady ..... 82/131
4,653,233 A 3/1987 Brueck
4,866,884 A 9/1989 Smith et al.
4,989,316 A * 2/1991 Logan et al. ..... 29/558
5,181,345 A 1/1993 Kulan
5,485,771 A * 1/1996 Brennan et al. ..... 82/1.11
5,615,588 A * 4/1997 Gottschald ..... 82/11
5,704,735 A 1/1998 Moreau
5,919,013 A 7/1999 Savoie
5,938,381 A 8/1999 Diehl et al.
6,122,999 A * 9/2000 Durazo et al. ..... 82/118
6,203,409 B1 * 3/2001 Kennedy et al. ..... 451/43
6,478,657 B1 * 11/2002 Shibata ..... 451/5
6,623,339 B1 * 9/2003 Igarashi et al. ..... 451/42

(Continued)

FOREIGN PATENT DOCUMENTS

EP 0 439 425 B1 1/1991

(Continued)

*Primary Examiner*—Dana Ross
(74) *Attorney, Agent, or Firm*—Reising, Ethington, Barnes, Kisselle, P.C.

(57) ABSTRACT

An apparatus (10) for generating a surface (S) on a workpiece (W) is proposed, which comprises a workpiece chuck (17) having a longitudinal axis (L), a spindle (18) for rotating a fly cutting tool (20) having a tool tip (48), and a moving device for moving the spindle generally transverse to the axis (L). The spindle further has a rotary encoder (42) for detecting an angle of tool rotation (γ), wherein the chuck is operatively connected with a fast workpiece servo (50) capable of moving it over short distances at high velocities. The servo is controllable taking into account the given angle of tool rotation so that the workpiece can be advanced toward and retracted from the tool in a defined manner while being cut by the tool tip. The limited geometry of the tool can thus be modified by moving the workpiece relative to the tool tip.

14 Claims, 4 Drawing Sheets

U.S. PATENT DOCUMENTS

| | | | | |
|---|---|---|---|---|
| 6,991,525 | B2 * | 1/2006 | Diehl et al. | 451/65 |
| 7,219,407 | B2 * | 5/2007 | Schneider et al. | 29/27 C |
| 7,308,745 | B2 * | 12/2007 | Diehl et al. | 29/50 |
| 7,322,082 | B2 * | 1/2008 | Natsume et al. | 29/27 C |

FOREIGN PATENT DOCUMENTS

| | | |
|---|---|---|
| EP | 1 719 584 A1 | 11/2006 |
| WO | WO 99/33611 | 7/1999 |
| WO | WO 02/06005 A1 | 1/2002 |

* cited by examiner

APPARATUS AND METHOD FOR GENERATING AN OPTICAL SURFACE ON A WORKPIECE

FIELD OF THE INVENTION

The present invention relates to an apparatus for generating an optical surface on a workpiece and a method for generating an optical surface on a workpiece using such apparatus.

BACKGROUND OF THE INVENTION AND PRIOR ART

Increasingly the prescription surfaces of ophthalmic lenses have a so-called "freeform" geometry, such as that used in progressive addition lenses (PALs). Freeform optical surfaces are defined as any non-rotationally symmetric surface or a symmetric surface that is rotated about any axis that is not its axis of symmetry. Current state of the art in freeform lens curve generating technology offers only a few different options. These options are three dimensional lens milling, three dimensional lens grinding and three dimensional lens turning.

Three dimensional lens milling can be described as a simple rotating tool with a single or multiple attached cutter blades spinning at a relatively high rotational speed. The tool is moved relative to the desired lens surface in using at least three axes of motion. Each time a cutter blade cuts into the lens surface, a small "bite" is taken out of the surface, leaving behind a slightly scalloped surface, but of the desired general curve geometry. Such process is described in, e.g., document EP-A-0 758 571 by the same applicant. Although a very good cutting rate and consequently short machining times that meet industrial requirements can be obtained with this known method, it would be desirable, in certain applications, to obtain an even better surface quality, particularly in the case of complex optical surfaces, such as freeform surfaces.

To this end document EP-A-1 291 106 by the same applicant proposes a method for the surface machining of in particular plastic spectacle lenses, which method starts with a three dimensional lens milling step, and finishes with a turning step to remove the "scallops", and improve the surface finish. The turning step however adds to the machining time.

An infinitely high spindle speed, or an infinitely high number of cutter blades mounted to the tool and perfectly aligned relative to the axis of rotation would provide infinitely small "bites" out of the surface, and therefore provide a surface with improved quality, i.e. one without the scalloped appearance. A grinding wheel can be thought of as a tool having an infinite number of cutters, however grinding does not work very well with plastic materials.

In three dimensional lens grinding, a grinding wheel of similar general geometry to that of the milling tool described above is positioned according to the same three axis tool motion path to achieve the same lens shape as that achieved with the milling tool. Grinding however typically works well for hard brittle materials like mineral glass, but not so well for soft ductile materials like most plastics. The soft materials tend to adhere to the grinding wheel which loads the grinding surface and prevents further cutting.

Three dimensional lens turning, also called "Fast Tool Single Point Diamond Turning" (SPDT), is currently the technology of choice to obtain high quality surface finish at relatively high speeds. As becomes apparent from, e.g., document WO-A-02/06005 by the same inventor, this technology uses a fast moving, short travel turning tool, controlled at high frequencies, and synchronized in motion to the work piece turning spindle, and the cross axis position, to obtain the desired freeform shape. One limitation to this approach is the surface speed of zero at the center of the lens, creating undesirable "center features", as described in European patent application 05 009 894.6 by the same applicant. Precise tool calibration is required to minimize such undesirable "center features", however the zero surface speed and other geometry issues at center make it difficult to completely eliminate all undesirable "center features".

Two other well known generating technologies generally considered to be not capable of generating freeform shapes are cup wheel grinding and "Single Point Diamond Fly Cutting" (SPDFC):

Cup wheel grinding is a method used with hard brittle materials to achieve excellent surfaces on spheres, rotationally symmetrical aspheres, and toric surfaces. The cup wheel tool is maintained in contact with the lens surface for its entire rotation, therefore providing better surfaces. Such process is described in, e.g., documents U.S. Pat. No. 4,866,884 and U.S. Pat. No. 5,181,345. Again, cup wheel grinding typically works well for hard brittle materials like mineral glass, but not so well for soft ductile materials like most plastics which adhere to and load up the cup wheel tool.

Very similar in geometry and therefore curvature limitations to cup wheel grinding described above is SPDFC. On organic (plastic) materials SPDFC is capable of providing one of the best surface qualities of all the technologies listed to date. On standard toric and spherical surfaces the relative surface speed of the tool—the fly cutting tool is a single-point cutting tool similar to a lathe tool mounted in a special rotating holder—is maintained to be very constant, and relatively high. An elliptical toroidal shape is obtained when cutting toric curves. This toroid is different from a true toric shape and is therefore said to have "elliptical error". Examples of fly cutting tools can be found in document U.S. Pat. No. 5,919,013 by the same inventor and document U.S. Pat. No. 5,704,735.

What is needed is an improvement in the machining quality while maintaining acceptable machining times for cutting ophthalmic lenses with freeform optical surfaces.

What is also needed is an apparatus and an efficient method, by means of which optical surfaces having in particular a freeform geometry can be generated with high surface quality and at appropriate cutting rates.

SUMMARY OF THE INVENTION

According to one aspect of the present invention, an apparatus for generating an optical surface on a workpiece, for example an ophthalmic lens, has a chuck for chucking the workpiece to be processed, the chuck having a longitudinal axis L, a tool spindle arrangement for rotating about an axis of tool rotation C a fly cutting tool having a tool tip for cutting the workpiece, and a moving system for moving one of the chuck and the tool spindle arrangement generally transverse to the longitudinal axis L of the chuck. The tool spindle arrangement includes a rotary encoder for detecting an angle of rotation of the fly cutting tool about the axis of tool rotation and thus an angular position of the tool tip relative to the workpiece, wherein the chuck is operatively connected with a fast workpiece servo (in the following referred to as "FWS") capable of moving the chuck over short distances at high velocities, the FWS being controllable taking into account the given angle of rotation of the fly cutting tool so that the workpiece can be advanced toward and retracted from the fly cutting tool in a defined manner while the workpiece is being cut by the tool tip.

By virtue of the structure of the apparatus according to the present invention, in particular, a method for generating an optical surface on a workpiece, for example an ophthalmic lens, can be performed, which method comprises the steps of:

entering surface data of a desired surface of the workpiece to be processed into a control unit;

executing in the control unit best fit analysis of the surface data to determine a best fit surface to the desired surface;

calculating in the control unit deviations of the determined best fit surface from the desired surface in the direction in which the FWS is capable of moving the chuck;

controlling by the control unit the motions of the moving means so that the fly cutting tool which is rotated about the axis of tool rotation, is moved through the workpiece along a path corresponding to the determined best fit surface; and simultaneously controlling, by the control unit, the FWS taking into account the given angle of rotation of the fly cutting tool about the axis of tool rotation C so that the workpiece is advanced toward and retracted from the fly cutting tool in real time corresponding to the calculated deviations of the determined best fit surface from the desired surface in order to generate the desired surface by the tool tip.

The major advantage of the apparatus of the present invention and the proposed method is that the optical surfaces generated thereon/therewith are exceptionally smooth while there is no limitation as for the surface geometry, i.e. even freeform surfaces can be generated with exceptional surface quality. The ophthalmic lenses generated on the apparatus of the present invention and by the proposed method, respectively, can have a surface finish which is an optically acceptable final finish, i.e. a finish in which no further polishing is required.

In other words, the new generator concept being proposed here is completely different than the technologies described above for freeform lens curve generating, while borrowing concepts of known generating technologies, namely the general tool movement and associated high surface quality single-point cutting of SPDFC combined with the fast tool servo motion used in SPDT to obtain any desired shape, the latter motion applied however on the workpiece taking into account the given angle of rotation of the tool. At the same time the drawbacks of these known generating technologies are easily overcome, that is the limited geometry capability of SPDFC and the undesired "center features" of SPDT. The "undesirable center feature" may be eliminated without the need for precise tool calibration.

In principle it is possible to design the FWS in such a way that it is capable of swiveling the chuck about a swivel axis in order to advance the chuck carrying the workpiece toward the fly cutting tool and retract it therefrom, respectively. Such "rotary" design of the FWS could be similar to that disclosed in document WO-A-99/33611 for rotary SPDT fast tool arrangements. Preference is given however, particularly with regard to the simplest possible mathematics when controlling the movement axes, to a design in which the FWS is capable of moving the chuck, positionally controlled by CNC, along a linear F-axis toward and away from the fly cutting tool.

Preferably, the moving system includes a rotary table carrying the tool spindle arrangement so that the latter can be swiveled about a swivel axis A which runs perpendicular to the axis of tool rotation, a first linear moving device for causing a relative motion between the chuck and the tool spindle arrangement toward and away from each other in a linear X-axis, and a second linear moving device for causing a lateral relative motion between the chuck and the tool spindle arrangement in a linear Y-axis which runs perpendicular to the X-axis. According to the particular machining requirements, however, other designs are conceivable for the moving means, as long as those are capable of causing a relative movement of workpiece and fly cutting tool generally transverse to the longitudinal axis of the chuck.

Preferably the F-axis of the FWS and the X-axis of the first linear moving means are parallel to each other, again simplifying the mathematics when controlling the movement axes.

Although a cross slide arrangement on the side of the FWS, or an arrangement with split linear moving means, one on the side of the FWS (e.g. the Y-axis) and the other on the side of the rotary table (e.g. the X-axis)—as in the generic prior art according to document U.S. Pat. No. 5,919,013—are conceivable, a design is preferred in which the first linear moving means and the second linear moving means are formed by a cross slide arrangement carrying the rotary table together with the tool spindle arrangement. This is because such design offers the advantage that the reciprocating movement of the FWS does not have any detrimental effect on the motion control in the A-, X- and Y-axes, i.e. unwanted oscillations are not or marginally only transferred from the FWS to the A-, X- and Y-axes.

With both generating prescription surfaces on ophthalmic lenses and a structure of the generating apparatus as simple as possible in mind the best fit surface determined in the proposed method may be a best fit toroidal surface. However, other mathematically defined geometries for the best fit surface are foreseeable as well, e.g. a spherical best fit surface.

Finally it should be mentioned that, although the apparatus according to the present invention and the proposed method are particularly suited for generating freeform surfaces, they are not limited on this, but are capable of generating any desired surface.

BRIEF DESCRIPTION OF THE DRAWINGS

The invention will be explained in more detail below on the basis of a preferred example of embodiment and with reference to the accompanying diagrammatic drawings, in which.

DETAILED DESCRIPTION OF THE PREFERRED EMBODIMENT

Figure 1:
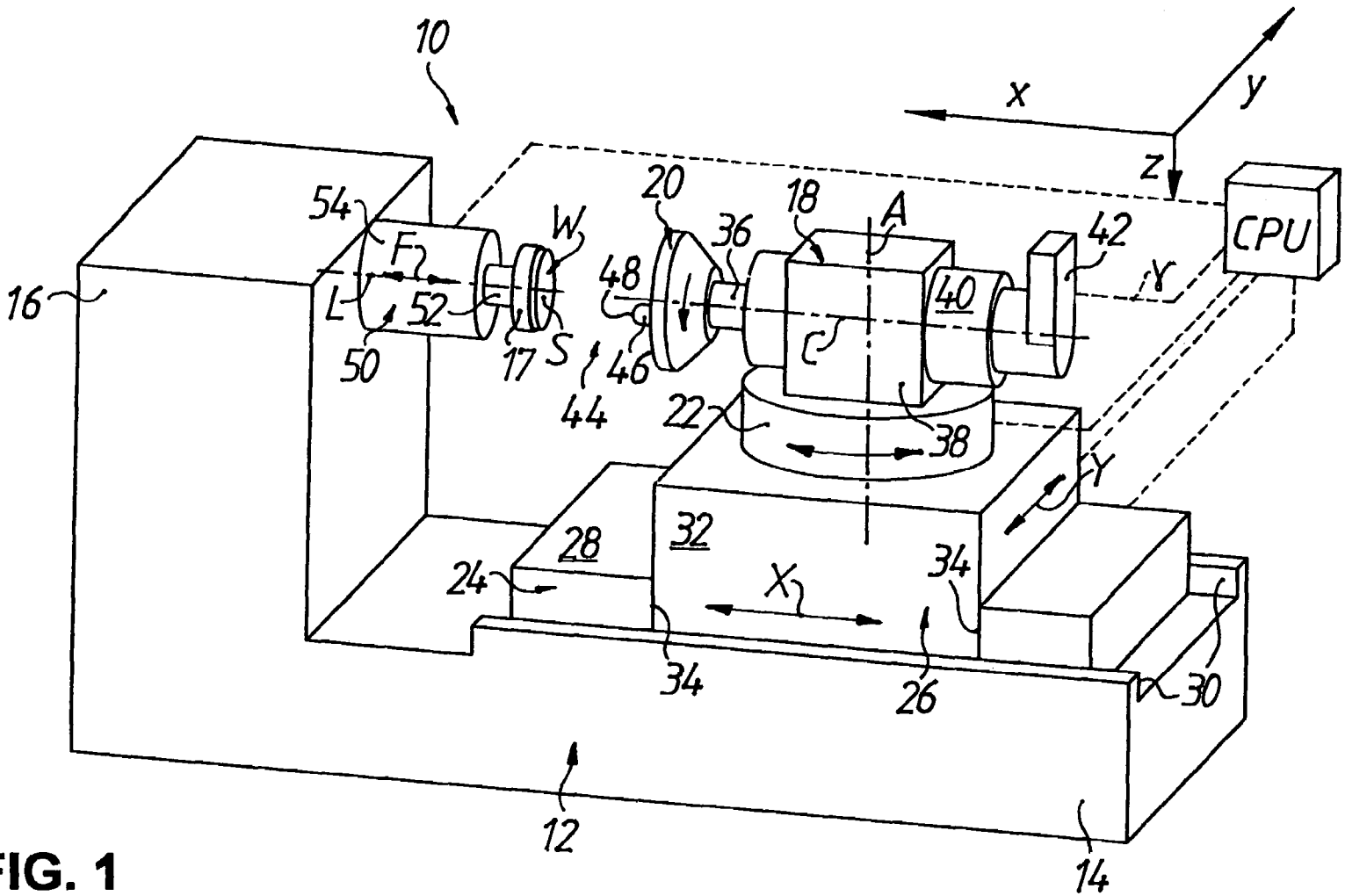
FIG. 1 shows an ophthalmic lens generating apparatus according to the present invention in a diagrammatic, top and right side perspective view, indicating in particular the axis convention used throughout the specification.
Figure 2:
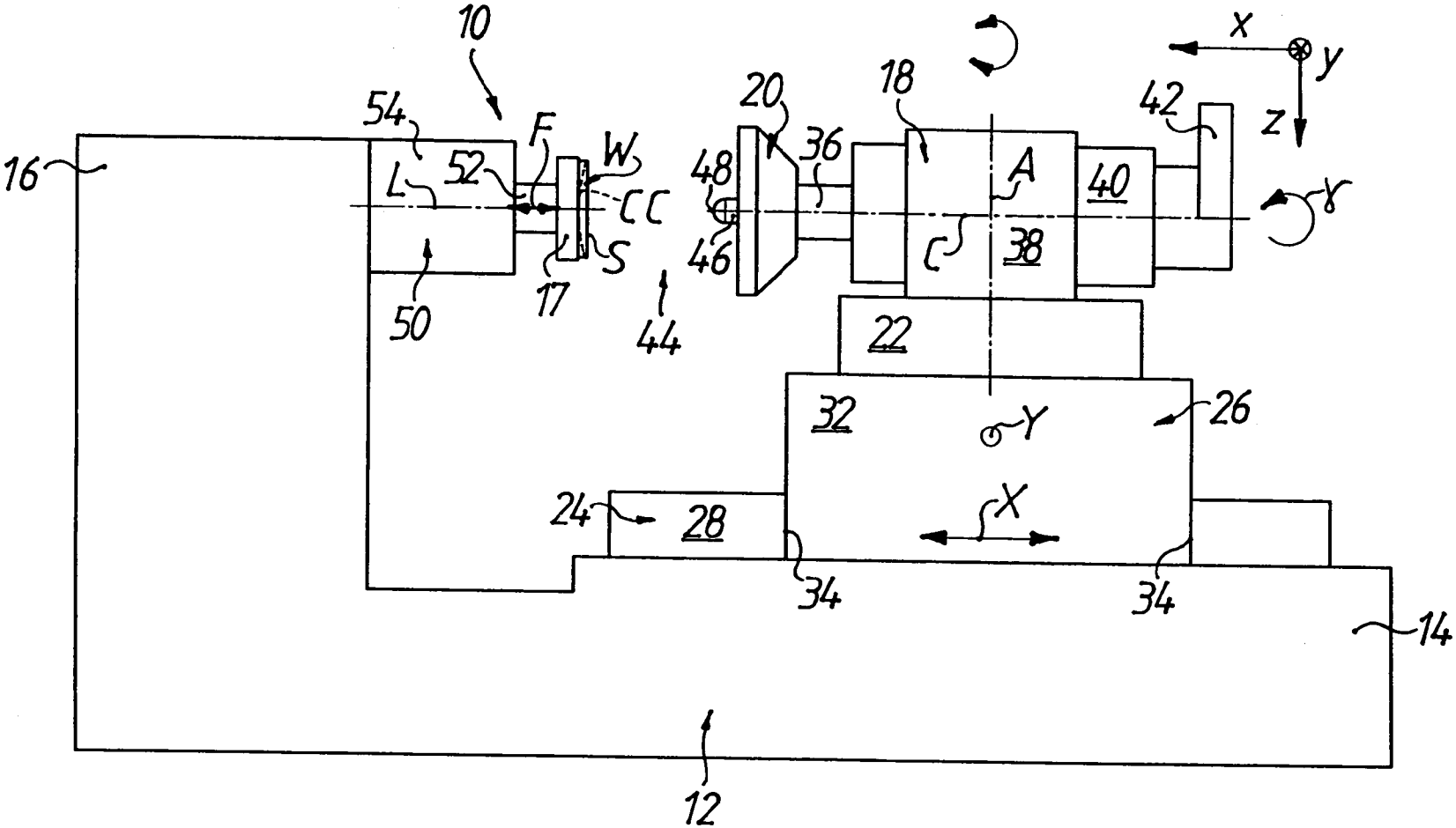
FIG. 2 shows a diagrammatic side view of the ophthalmic lens generating apparatus according to FIG. 1.
Figure 3:
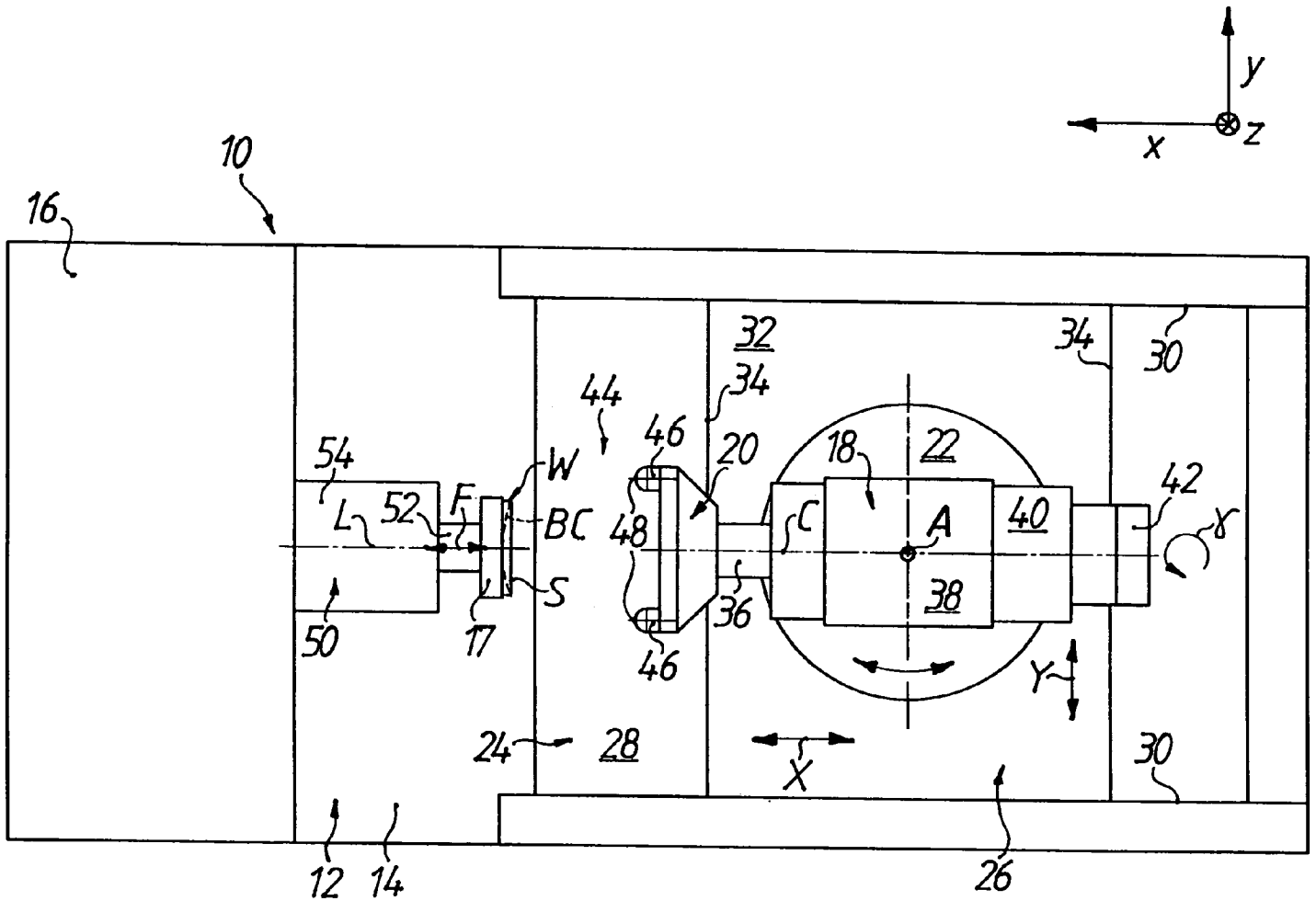
FIG. 3 shows a diagrammatic top view of the ophthalmic lens generating apparatus according to FIG. 1.

The ophthalmic lens generating apparatus 10 of the preferred embodiment is illustrated in its functional entirety in FIGS. 1, 2 and 3 in a right-angled Cartesian coordinate system, in which the small letters x, y and z respectively denote the width direction (x), the length direction (y) and the height direction (z) of the apparatus 10. As indicated earlier the ophthalmic lens generating apparatus 10 is shown in the Figures diagrammatically only, wherein the casings and protective devices and the like of the apparatus 10 have been omitted for the sake of clarity.

The ophthalmic lens generating apparatus 10 of the preferred embodiment has a massive machine base 12 with a horizontal part 14 and a vertical part 16. The vertical part 16 of the machine base 12 indirectly supports—in a manner that will be explained later—a chuck 17 having a longitudinal axis L, for chucking, in a manner known in the art, an ophthalmic lens as workpiece W to be processed. The horizontal part 14 of the machine base 12 carries a support structure assigned to a tool spindle arrangement 18 for rotating about an axis of tool rotation C a fly cutting tool 20.

In the preferred embodiment the support structure of the tool spindle arrangement 18 has three degrees of freedom. It has a rotary table 22 carrying the tool spindle arrangement 18 so that the latter can be swiveled about a swivel axis A which runs perpendicular to the axis of tool rotation C. It also has a first linear moving device 24 for causing a relative motion between the tool spindle arrangement 18 and the chuck 17 toward and away from each other in a linear X-axis, and a second linear moving device 26 for causing a lateral relative motion between the tool spindle arrangement 18 and the chuck 17 in a linear Y-axis which runs perpendicular to the X-axis. Thus, the support structure of the tool spindle arrangement 18 is capable of moving laterally generally transverse to the longitudinal axis L of the chuck 17.

To be more precise, the second linear moving device 26 and the first linear moving device 24 are stacked to form a cross slide moving system, with an X-slide 28 guided along assigned guideways 30 on the horizontal part 14 of the machine base 12 and displaceable horizontally in both directions of the X-axis by assigned CNC drive and control elements (not shown), and a Y-slide 32 guided along assigned guideways 34 on the X-slide 28 and displaceable horizontally in both directions of the Y-axis by assigned CNC drive and control elements (not shown). Mounted to an upper surface of the Y-slide 32 is the rotary table 22 which can be driven to swivel about the swivel axis A in both the clockwise direction and the counterclockwise direction, respectively, by assigned CNC drive and control elements (likewise not shown). Mounted to an upper surface of the rotary table 22 then is the tool spindle arrangement 18 substantially comprising: a spindle shaft 36 to which the fly cutting tool 20 is attached in a manner known in the art, a spindle headstock 38 for rotatably supporting the spindle shaft 36, an electric spindle motor 40 for rotating the spindle shaft 36 about the axis of tool rotation C, with at least the spindle speed being controlled, and finally a rotary encoder 42 for detecting an angle of rotation γ of the fly cutting tool 20 about the axis of tool rotation C.

As can further be seen in FIGS. 1, 2 and 3, the fly cutting tool 20 extends into a machining area 44 of the ophthalmic lens generating apparatus 10. Preferably the fly cutting tool 20 has at least one cutter insert 46 defining the tool tip, which allows for replacement of the cutter insert(s) if required. As to the number of cutter inserts 46 it should be noted here that, if the mathematics and the control effort shall be kept as simple as possible, only one cutter insert 46 would be preferred. Providing for two (or more) cutter inserts 46 on opposite places of the fly cutting tool however offers the advantage that different cutter inserts with varying cutting edge geometries could be used, e.g., one for a roughing cut, another for a finishing cut. In such embodiment the roughing cutter insert could be shorter that the finishing cutter insert so that the tool tip on the roughing cutter insert would be offset backwards by a predefined amount in relation to the circular orbit of the tool tip on the finishing cutter insert. In the roughing cut where dynamics are not so important the fly cutting tool could then rotate at moderate speed while the Fast Working Servo 50 "FWS" would retract the chucked workpiece each time the finishing cutter insert passes the workpiece to make sure that the finishing cutter insert does not come into machining engagement with the workpiece, and then again advance the workpiece toward the fly cutting tool to bring the surface of the workpiece to be machined into a defined machining engagement with the roughing cutter insert. Subsequently, in the finishing cut where dynamics are important for obtaining a high surface quality, the fly cutting tool could be rotated at a higher speed while the FWS would adjust the position of the workpiece in accordance with the geometry to be generated only, i.e. there would be no need for the FWS to make sure that the workpiece does not come into machining engagement with the roughing cutter insert since the circular orbit of the tool tip on the finishing cutter insert 46 "protrudes" beyond the circular orbit of the tool tip on the roughing cutter insert in the direction of the workpiece. In such embodiment the circular orbits of the tool tips on the different cutter inserts 46 could have the same diameter, but this is not a must. The number of cutter inserts 46 is limited upwards by the fact that, in generating geometries of complex shape, one must make sure that only one cutter insert is in machining engagement with the workpiece at the same time. Apart from that the fly cutting tool 20 may be designed as disclosed in document U.S. Pat. No. 5,704,735 or the generic prior art according to document U.S. Pat. No. 5,919,013 by the same inventor.

On the left hand side of the machining area 44 in FIGS. 1, 2 and 3 the chuck 17 extending into the machining area 44 is operatively connected with a fast workpiece servo ("FWS") 50 capable of moving the chuck 17 over short distances at high velocities. To be more precise, in the exemplary embodiment shown, the FWS 50 is capable of moving the chuck 17, positionally controlled by CNC, along a linear F-axis toward and away from the fly cutting tool 20, wherein the F-axis of the FWS 50 and the X-axis of the first linear moving means 24 are parallel to each other. The FWS 50 itself is fixed to the vertical part 16 of the machine base 12 in the exemplary embodiment. However, the FWS 50 as a whole (or the chuck 17 relative to the FWS 50) may also be rotatable about an axis parallel to the longitudinal axis L of the chuck 17 by means of a rotary actuator (not shown), for the purpose of angularly positioning an ophthalmic lens as workpiece W according to the requirements of a prescription, prior to the surface generating process. Nevertheless, in this modification as well, the workpiece W would be fixed against rotation relative to the machine base 12 during the machining operation. Likewise a further linear moving means for moving up and down the FWS 50 in the height direction z of the ophthalmic lens generating apparatus 10 could be provided for, which could be utilized for generating prism.

Since the angle of rotation γ of the fly cutting tool 20 about the axis of tool rotation C can be detected via the rotary encoder 42, the angular position of the (respective) tool tip 48 relative to the chuck 17 and thus the workpiece W held by the chuck 17 is known. In addition, the complete positional information of the tool spindle arrangement 18 relative to the chuck 17/workpiece W in the x-, y- and z-coordinates and in the A-axis is known. The general machine 10 and tool 20 geometry is also known, together with the angle of rotation γ one can establish the complete spatial position of the tool tip 48 relative to the workpiece W at discrete points along the entire (best fit) cut path. This positional information is used in controlling the FWS 50. To be more precise, the FWS 50 is controlled in dependence on the given spatial position (including the given angle of rotation γ about the axis of tool rotation C) of the fly cutting tool 20 in such a way that by means of the FWS 50 the workpiece W is advanced toward and retracted from the fly cutting tool 20 along the F-axis in a defined manner, i.e. in accordance with the surface geometry to be generated while the workpiece W is being cut by the (respective) tool tip 48, as will be explained in more detail below with the aid of FIGS. 4 and 5.

In the Figures the (inner) structure of the FWS 50 is not shown in detail. Basically, it may correspond to that of a so-called "fast tool" device as disclosed in, e.g., document WO-A-02/06005 by the same inventor (see for example, FIG. 7 thereof) which is herein incorporated by reference. Accordingly, the FWS 50 comprises a high bandwidth actuator (not shown) and a shuttle, the latter being denoted with 52 in FIGS. 1, 2 and 3. The shuttle 52 is axially movable in both directions of the F-axis by the actuator, with the stroke controlled by CNC. Active or passive mass compensation could additionally be provided for to minimize reaction forces coming from the accelerations during motion of the FWS 50. This compensation could be implemented to be axially in line with the F-axis or parallel to the F-axis (as shown in WO-A-02/06005 by the same inventor for so-called "fast tool" devices).

Further, the actuator may be a "voice coil" type actuator, including a magnet assembly attached to the housing 54 of the FWS 50 and defining a ring gap, and an electrical coil secured to the shuttle 52 and plunging into the ring gap. Coil wires provide electrical input to the coil to cause relative movement between the coil and the magnet assembly, as is the case with loudspeakers. The shuttle 52 itself is mounted to the housing 54 of the FWS 50 for linear movement, wherein various mounting arrangements may be utilized. A preferred mounting arrangement is to use aerostatic or hydrostatic bearing pads between the housing 54 of the FWS 50 and the shuttle 52 to allow for smooth, accurate linear motion. There are however alternative mounting methods using, e.g., flexures or rolling element bearings. Of course, appropriate CNC-control elements need to be provided for—e.g., a diffraction scale as position encoder on the shuttle 52 readable by an assigned reading head secured to the housing 54 of the FWS 50—so that the axial position of the shuttle 52 relative to the housing 54 of the FWS 50 can be sensed and a related input to the coil can be generated to vary the position of the shuttle 52 in accordance with a pre-determined position.

Although the actuator of the FWS 50 has been described above as a "voice coil" type actuator, depending on in particular the dynamic and stroke requirements other actuators may be utilized, e.g. a piezoelectric actuator driving for instance a flexure-mounted shuttle (higher bandwidth, shorter stroke), or a linear motor (lower bandwidth, longer stroke), or any other suitable force (torque)/motion producing device.

Representative preferred characteristics for the tool spindle arrangement 18 and the FWS 50 with "voice coil" type actuator are as follows: Diameter of workpiece W: up to 100 mm. Diameter of fly cutting tool 20 (circular orbit of tool tip 48): 50 to 150 mm. Stroke of FWS 50: up to 5 mm. Acceleration of FWS 50: 20 to 100 g (1 g=9,81 m/s$^2$). Maximum speed of FWS 50: approximately 1 m/s. RPM of tool spindle 18 (working range): 1000 to 6000 l/min.

Finally, the broken lines in FIG. 1 illustrate the (electrical) connection of the moving means 22, 24, 26 for moving the tool spindle arrangement 18, of the rotary encoder 42 for detecting the angular position of the fly cutting tool 20 relative to the workpiece W held by the chuck 17, and of the FWS 50 with a control unit CPU for positionally controlling all CNC-axes (A, F, X, Y) while taking into account the angular position of the fly cutting tool 20 about the axis of tool rotation C.

Figure 4:
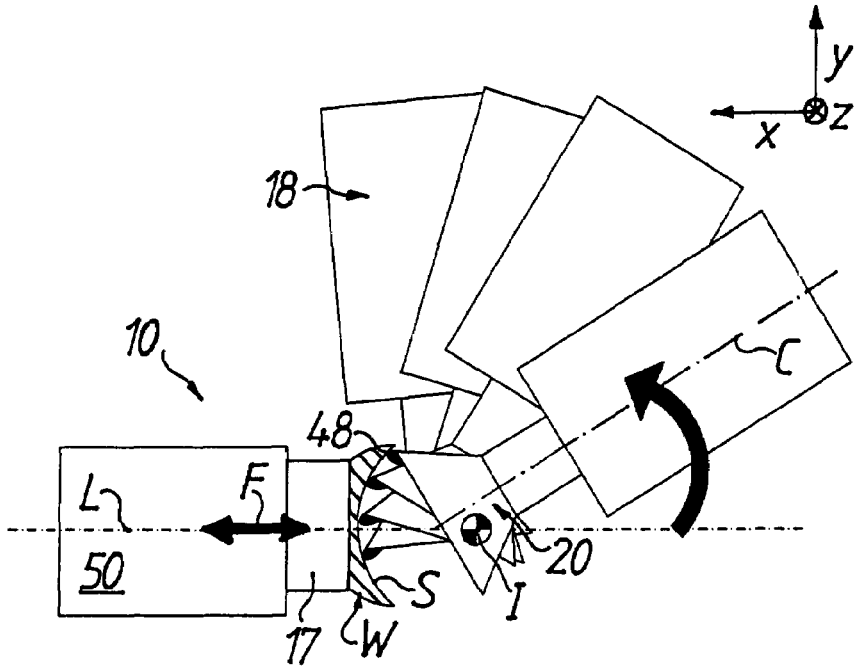
FIG. 4 illustrates in a diagrammatic top view the method of operation of the ophthalmic lens generating apparatus according to the present invention, in which a fly cutting tool having one cutter insert is swept through the lens W about a swivel axis I obtained by simultaneously controlling by CNC the X-, Y- and A-axes of the ophthalmic lens generating apparatus according to FIGS. 1 to 3, while the FWS is being adjusted by CNC in the F-axis taking into account the given angle of rotation of the fly cutting tool.

As to the operation of the ophthalmic lens generating apparatus 10 described so far, it is evident to the person skilled in the art that, by appropriately controlling the A-, X- and Y-axes of the apparatus 10, the fly cutting tool 20 rotating at relatively high speed about the axis of tool rotation C can be "swept" through the workpiece W which is held by the chuck 17 in a manner fixed against rotation, wherein the whole tool spindle arrangement 18 is in effect pivoted about a swivel axis I which is parallel to the swivel axis A of the rotary table 22 and perpendicular to the axis of tool rotation C. This motion is illustrated in FIG. 4. In case the chuck 17 is held stationary by the FWS 50 in the F-axis during this "sweeping" motion of the rotating fly cutting tool 20 an arc along the edge of the tool 20 describes a determined curvature across the surface of the workpiece W; as in the known SPDFC process the arc along the edge of the tool 20 and the determined curvature define a surface T having a toroidal shape on the workpiece W (cf. FIG. 5), with a base curve BC when viewed from above and a cylinder curve CC when viewed from the side. These curves BC, CC which can be adjusted by suitably controlling the A-, X- and Y-axes are illustrated with broken lines in FIGS. 2 and 3.

The above "sweeping" motion of the rotating fly cutting tool 20 can now be overlaid or superimposed by an "oscillating" motion of the chuck 17 in the F-axis, generated by the FWS 50 taking into account the angular position of the tool 20 relative to the chuck 17 and thus the workpiece W, to obtain any desired surface geometry, in particular free-form shapes, with the smoothness and consequent surface quality comparable to that obtained with the conventional SPDFC process, and without the undesired center features of the known SPDT process.

Figure 5:
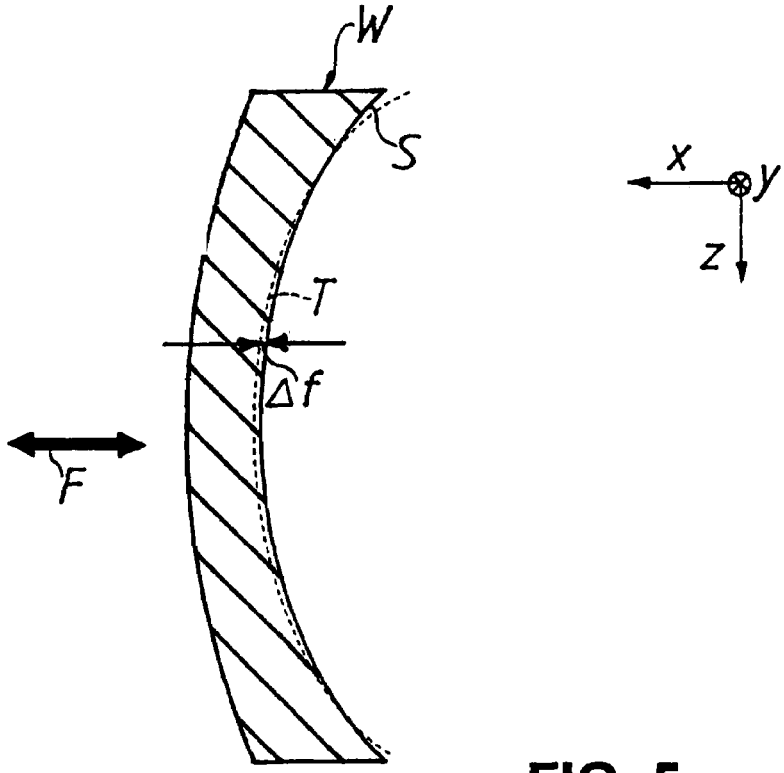
FIG. 5 is a sectional view of the lens W illustrating in a scale enlarged in relation to FIGS. 1 to 4 the optical surface S of the lens W cut with the ophthalmic lens generating apparatus according to the present invention, in which the broken line T represents an imaginary best fit toroidal surface which would be generated by the fly cutting tool during its sweep through the lens W if the lens chuck would be fixed, whereas the solid line (at S) represents a desired (e.g. freeform) surface actually obtained by simultaneously adjusting the position of the lens W in the x-direction via the FWS (F-axis) of the ophthalmic lens generating apparatus.

To this end a preferred method for generating an optical surface S on for example an ophthalmic lens as the workpiece W, and utilizing the ophthalmic lens generating apparatus 10 as described above may include the following steps:

entering surface data of a desired surface S of the workpiece W to be processed into the control unit CPU;

executing in the control unit CPU best fit analysis (which is known per se) of the surface data to determine best fit (toroidal) surface T to the desired surface S;

calculating in the control unit CPU deviations Δf (as shown in FIG. 5) of the determined best fit (toroidal) surface T from the desired surface S in the direction in which the FWS 50 is capable of moving the chuck 17, i.e. in the direction of the F-axis in the preferred embodiment shown;

controlling by the control unit CPU the motions of the moving means 22, 24, 26 so that the fly cutting tool 20 which is rotated about the axis of tool rotation C, is moved through the workpiece W along a path corresponding to the determined best fit (toroidal) surface T ("normal" path of the tool tip 48 of the fly cutting tool 20 with "sweeping" motion as illustrated in FIG. 4); and simultaneously controlling, by the control unit CPU, the FWS 50 taking into account the given angle of rotation γ of the fly cutting tool 20 about the axis of tool rotation C so that the workpiece W is advanced toward and retracted from the fly cutting tool 20 in real time corresponding to the calculated deviations Δf of the determined best fit (toroidal) surface T from the desired surface S in order to generate by the tool tip 48 the final desired surface S (curve adjusted by the "oscillating" motion of the FWS 50, i.e. by moving closer or further away the workpiece W relative to the "normal" path of the tool tip 48 of the fly cutting tool 20).

Finally it should be mentioned that, although the ophthalmic lens generating apparatus 10 has been described above to possess several CNC-axes, it is evident to the person skilled in the art that the aforementioned (best fit) toroidal surface can be generated without any CNC-axis being necessary; for instance by means of a machine structure as disclosed in document U.S. Pat. No. 4,653,233 which is herein incorporated by reference used with a fly cutting tool instead of a cup wheel grinding tool. To summarize the basic concept of the present invention only necessitates the additional knowledge of the angular position in addition to the known spatial position of the fly cutting tool at all discrete points along the (best fit) cut path relative to the workpiece to be cut, and the capability to position, either pivotally or linearly, the workpiece over short distances with high velocities toward and away from the tool in dependence on the given spatial position of the tool relative to the workpiece in order to "compensate" for deviations between the geometry which would be cut by the tool without the workpiece being able to move toward and away from the tool, and the desired geometry. Therefore, although a particular embodiment of the invention has been disclosed in detail for illustrative purposes, it will be recognized that various variations or modifications of the disclosed apparatus and method lie within the scope of the present invention as defined in the appended claims.

An apparatus for generating a surface on a workpiece is proposed, which comprises a workpiece chuck having a longitudinal axis L, a spindle for rotating a fly cutting tool having a tool tip, and a moving means for moving, e.g., the spindle generally transverse to the axis L. The spindle further comprises a rotary encoder for detecting an angle of tool rotation, wherein the chuck is operatively connected with a fast workpiece servo capable of moving it over short distances at high velocities, the servo being controllable taking into account the given angle of tool rotation so that the workpiece can be advanced toward and retracted from the tool in a defined manner while being cut by the tool tip. The limited geometry of the tool can thus be modified by moving the workpiece relative to the tool tip.

Other variations and modifications are possible without departing from the scope and spirit of the present invention as defined by the appended claims.

The invention claimed is:

1. An apparatus for generating an optical surface on an ophthalmic workpiece comprising:

a chuck for chucking the ophthalmic workpiece to be processed, said chuck having a longitudinal axis, a tool spindle arrangement for rotating about an axis of tool rotation a fly cutting tool having a tool tip for cutting the workpiece;

a moving system for moving one of said chuck and said tool spindle arrangement generally transverse to said longitudinal axis of said chuck;

said tool spindle arrangement comprises a rotary encoder for detecting an angle of rotation of said fly cutting tool about said axis of tool rotation and thus an angular position of said tool tip relative to the ophthalmic workpiece; and wherein said chuck is operatively connected with a fast workpiece servo capable of moving said chuck over short distances at high velocities, said fast workpiece servo being controllable taking into account the given angle of rotation of said fly cutting tool so that the ophthalmic workpiece can be advanced toward and retracted from said fly cutting tool in a defined manner while the ophthalmic workpiece is being cut by said tool tip.

2. The apparatus as defined in claim 1 further comprising: said fast workpiece servo being capable of moving said chuck, positionally controlled by CNC, along a linear F-axis toward and away from said fly cutting tool.

3. The apparatus as defined in claim 2 characterized in that said moving system comprising:

a rotary table carrying said tool spindle arrangement so that the latter can be swiveled about a swivel axis which runs perpendicular to said axis of tool rotation; and a first linear moving device for causing a relative motion between said chuck and said tool spindle arrangement toward and away from each other in a linear X-axis; and a second linear moving device for causing a lateral relative motion between said chuck and said tool spindle arrangement in a linear Y-axis which runs perpendicular to said X-axis.

4. The apparatus as defined in claim 3 further comprising: said F-axis of said fast workpiece servo and said X-axis of said first linear moving device being parallel to or aligned with each other.

5. The apparatus as defined in claim 4 further comprising: said first linear moving device and said second linear moving device being formed by a cross slide arrangement carrying both said rotary table and said tool spindle arrangement.

6. The apparatus as defined in claim 5 further comprising: said fly cutting tool has at least one cutter insert defining said tool tip.

7. The apparatus as defined in claim 1 further comprising: said fly cutting tool has at least one cutter insert defining said tool tip.

8. The apparatus as defined in claim 3 further comprising:

said first linear moving device and said second linear moving device being formed by a cross slide arrangement carrying both said rotary table and said tool spindle arrangement.

9. The apparatus as defined in claim 2 further comprising: said F-axis of said fast workpiece servo and said X-axis of said first linear moving device being parallel to or aligned with each other.

10. The apparatus as defined in claim 1 characterized in that said moving system comprising:

a rotary table carrying said tool spindle arrangement so that the latter can be swiveled about a swivel axis which runs perpendicular to said axis of tool rotation; and a first linear moving device for causing a relative motion between said chuck and said tool spindle arrangement toward and away from each other in a linear X-axis; and a second linear moving device for causing a lateral relative motion between said chuck and said tool spindle arrangement in a linear Y-axis which runs perpendicular to said X-axis.

11. A method for generating an optical surface on a workpiece, said method comprising the steps of:

entering surface data of a desired surface of the workpiece to be processed into a control unit;

executing in said control unit best fit analysis of said surface data to determine a best fit surface to the desired surface;

calculating in said control unit deviations of the determined best fit surface from the desired surface in the direction in which a fast workpiece servo is capable of moving a chuck;

controlling, by said control unit, the motions of a moving system so that a fly cutting tool which is rotated about an axis of tool rotation, is moved through the workpiece along a path corresponding to the determined best fit surface; and simultaneously controlling, by said control unit, said fast workpiece servo taking into account the given angle of rotation of said fly cutting tool about said axis of tool rotation so that the workpiece is advanced toward and retracted from said fly cutting tool in real time corresponding to the calculated deviations of the determined best fit surface from the desired surface in order to generate the desired surface by said tool tip.

12. The method as defined in claim 11 further comprising:

said best fit surface being a best fit toroidal surface.

13. The method as defined in claim 12 further comprising:

said desired surface being a freeform surface.

14. The method as defined in claim 11 further comprising:

said desired surface being a freeform surface.

* * * * *